US006171397B1

(12) United States Patent
Mitsuya

(10) Patent No.: US 6,171,397 B1
(45) Date of Patent: Jan. 9, 2001

(54) PAINT FILM TRANSFER DEVICE

(75) Inventor: Yoshihide Mitsuya, Kawagoe (JP)

(73) Assignee: Kotobuki & Co., Ltd., Kyoto (JP)

( * ) Notice: Under 35 U.S.C. 154(b), the term of this patent shall be extended for 0 days.

(21) Appl. No.: 09/113,522

(22) Filed: Jul. 10, 1998

(30) Foreign Application Priority Data

Jul. 11, 1997 (JP) ..... 9-186135

(51) Int. Cl.[7] ..... B05C 1/06

(52) U.S. Cl. ..... 118/257; 118/200; 156/577; 156/579; 400/696; 400/700

(58) Field of Search ..... 118/106, 200, 118/257; 156/577, 579; 400/695, 696, 700

(56) References Cited

U.S. PATENT DOCUMENTS 5,379,477 * 1/1995 Tamai et al. ..... 118/257

FOREIGN PATENT DOCUMENTS 05058097 3/1993 (JP) .
05178525 7/1993 (JP) .

* cited by examiner

*Primary Examiner*—Laura Edwards
(74) *Attorney, Agent, or Firm*—McGinn & Gibb, PLLC

(57) ABSTRACT

A film (e.a., a paint film) transfer device includes case, a supply reel around which paint film transfer tape is wound, and a take-up reel for taking-up used tape which is supplied from the supply reel and used. The supply and take-up reels are rotatably mounted in the case. The outermost peripheries of the supply reel and the take-up reel are constantly contacting each other, such that the take-up reel is rotated as the supply reel is rotated.

18 Claims, 6 Drawing Sheets

PAINT FILM TRANSFER DEVICE

BACKGROUND OF THE INVENTION

1. Field of the Invention

The present invention relates to a film transfer device, and more particularly to a paint transfer device which transfer a paint film paint film transfer tape, thereby enabling the device to use the tape as an eraser, marker or glue.

2. Description of the Related Art

Conventionally, such a paint film transfer device has been described in Japanese Patent Application Laid-Open Nos. 5-178525. The conventional paint film transfer device has a large gear mounted on a supply reel around which paint film transfer tape is wound, and a relatively small gear is mounted on a take-up reel which takes up the used tape, with the small gear meshing with the large gear. In operation, the paint film transfer tape is supplied from the supply reel. As the supply reel rotates, the take-up reel rotates through the large and small gears, so that the used tape is automatically taken-up.

However, such a conventional paint film transfer device is costly to manufacture due to its many components including the large and small gears.

Additionally, as the outer diameter of the supply reel becomes smaller and smaller, and that of the take-up reel correspondingly becomes larger and larger through using the paint film transfer tape, synchronization between the reels is lost, and excessive force is applied to the tape because the feeding speed becomes slower and slower, while the take-up speed becomes faster and faster. Thus, another problem is that the supply or take-up reel must be arranged to slip, which makes the arrangement unduly complicated.

SUMMARY OF THE INVENTION

In view of the foregoing and other problems of the conventional devices, an object of the present invention is to provide a paint film transfer device which can be inexpensively manufactured, and which can always synchronize supply of paint film transfer tape and taking-up of used tape with a simple arrangement.

To attain the above and other objects, a film transfer device according to a first aspect of the present invention includes a case, a supply reel around which paint film transfer tape is wound, and a take-up for taking-up the used tape which is supplied from the supply reel and used, the supply and take-up reels being rotatably mounted in the case, wherein the outermost peripheries of the supply and take-up reels constantly contact each other, such that the take-up reel is rotated as the supply reel is rotated.

In a second aspect, a paint film transfer device includes a supply reel around which a paint film transfer tape is wound, and a take-up reel for taking-up used film transfer tape which is supplied from the supply reel and used, the supply and take-up reels being rotatably mounted. Respective outermost peripheries of the supply reel and the take-up reels constantly contact each other, such that the take-up reel rotates as the supply reel rotates.

With the present invention, when the paint film transfer tape is supplied from the supply reel for use, the supply reel is rotated. Hence, since the outermost peripheries of the supply and take-up reel contact each other, the take-up reel is rotated in a direction opposite that of the supply reel, and automatically takes up the used tape.

Since supplying the paint film transfer tape and taking-up the used tape is synchronized simply without using gears, complex hardware, or the like, the paint film transfer device can be manufactured inexpensively.

Preferably, the paint film transfer device is provided with an urging mechanism which constantly urges at least one of the supply and the take-up reel in a direction where the supply reel and the take-up reel approach one another. The urging mechanism prevents slippage of the supply reel, so that the take-up reel reliably (e.g, always) rotates together with the supply reel.

Further, preferably, the urging mechanism is formed integrally with a support shaft for rotatably supporting either the supply reel or the take-up reel. Thus, the number of components is reduced, thereby allowing lower-cost manufacturing.

The present disclosure relates to subject matter contained in Japanese Patent Application No. 9-186135, filed Jul. 11, 1997, which is expressly incorporated herein by reference in its entirety.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF THE PREFERRED EMBODIMENTS OF THE INVENTION

Preferred, non-limiting, embodiments of the present invention are described in detail below with reference to the drawings.

First Embodiment

Referring to FIGS. 1–5, a transfer device 100 (e.g., a paint film transfer device) according to a first embodiment of the present invention is shown, which includes a case 10. The case 10 includes an upper lid 10*b* and a lower lid 10*c* which are closably formed by a hinge 10*a*. The upper and lower lids 10*b* and 10*c* are locked at a lock section 10*d* to form an internal space. An opening 11 is formed at the front end of the case 10.

Figure 1:
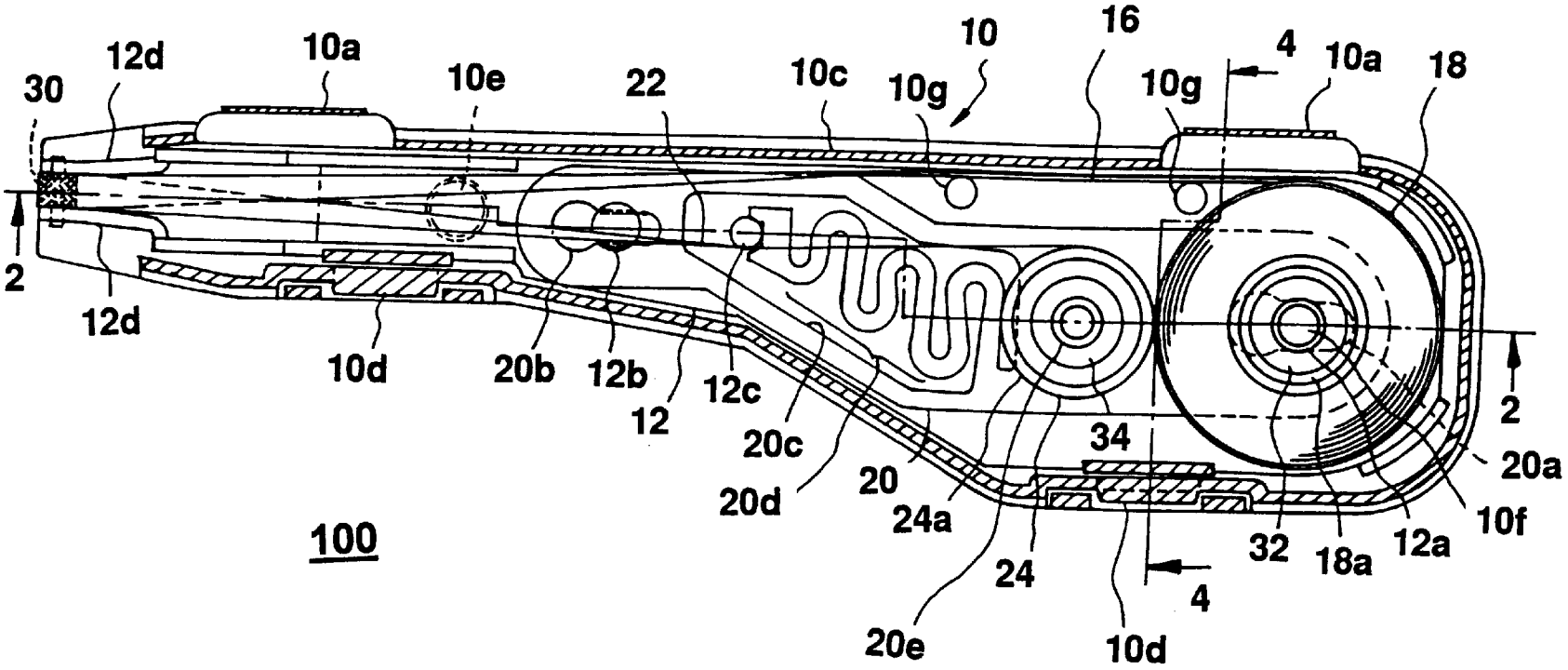
FIG. 1 is a sectional view showing a first embodiment of a paint film transfer device according to the present invention, but in which the inside of a case of the device is not shown in section.
Figure 2:
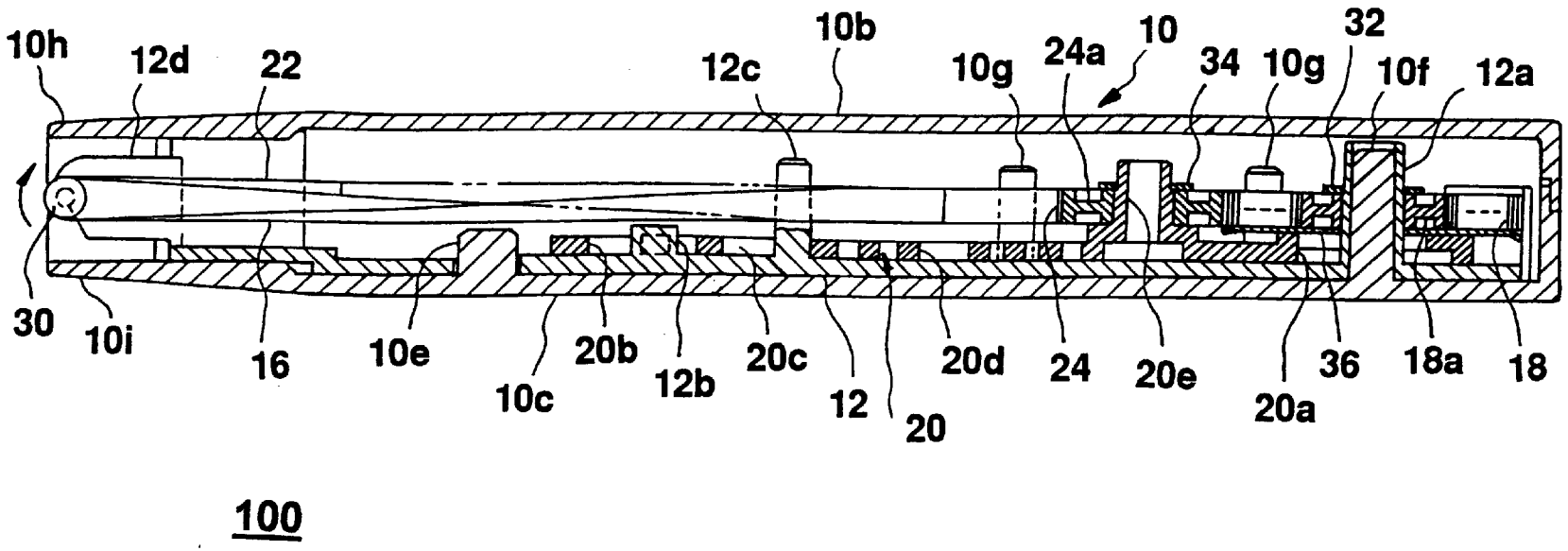
FIG. 2 is a sectional view taken along line 2—2 in FIG. 1.

Formed within the inner space of the case 10 are projections 10*e* and 10*f* formed on the lower lid 10*c* and projecting upward in FIG. 2. A fixed plate 12 is fixed in the lower lid 10*c* of the case 10, so that it is fitted onto the projections 10*e* and 10*f*. The projection 10*f* is fitted with a first cylindrical support shaft 12*a* of the fixed plate 12.

Additionally, a movable plate 20, preferably made of synthetic resin or the like, is placed on the fixed plate 12. The movable plate 20 has elongated holes 20*a* and 20*b* for slidably receiving, respectively, the first support shaft 12*a* of the fixed plate 12 and a projection 12*b* projecting from the fixed plate 12, thereby making the movable plate 20 slidable in the longitudinal direction of the case 10 with respect to the fixed plate 12.

Additionally, an opening 20*c* is provided at the center of the movable plate 20, and a resilient member 20*d* extending in the opening 20*c* in a zigzag(e.g., S-curved) fashion is formed integrally with the movable plate 20. The resilient member 20*d* is expandable and retractable as its zigzag shape is deformed, and can generate a resilient urging forced by virtue of the resilient material forming the member 20*d*. The front end of the resilient member 20*d* engages a second projection 12*c* projecting from the fixed plate 12. Additionally, a second cylindrical support shaft 20*e* is formed between the opening 20*c* and the elongated hole 20*b*.

A supply reel (e.g., wheel) 18 is rotatably fitted on the first support shaft 12*a* of the fixed plate 12, and a paint film transfer tape 16 is wound around supply reel 18.

Additionally, a take-up reel 24 is rotatably fitted on the second support shaft 20*e* of the movable plate 20, and used tape 22 is taken-up around the take-up reel 24. Holding plates 32 and 34 are press-fitted on the first and second support shafts 12*a* and 20*e* for holding the supply and take-up reels 18 and 24 from above, respectively. A support plate 36 is press-fitted on the first support 12*a* for supporting the supply and take-up reels 18 and 24 from below (e.g., as shown in FIG. 2).

The second support shaft 20*e* supporting the take-up reel 24 is constantly urged toward the first support shaft 12*a* by the resilient member 20*d* of the movable plate 20, such that the supply reel 18 and the take-up reel 24 constantly contact each other on their outermost peripheries (e.g., the tape on the outermost peripheries) with a substantially suitable force.

The paint film transfer tape 16 preferably includes a plastic-based film on which is laminated a peeling layer and an intended paint film layer, such as a white paint layer, on which in turn an adhesive layer, such as a pressure-sensitive adhesive, is laminated. The supply reel 18 is formed by winding the paint film transfer tape 16 around a hub 18*a*, such that the adhesive layer faces outwardly. Additionally, the used tape 22 is the paint film transfer tape 16, but with the paint film layer and the adhesive layer having been removed (e.g., applied to a surface of interest). The take-up reel 24 winds the used tape 22 therearound such that the peeling layer faces outwardly.

Figure 3:
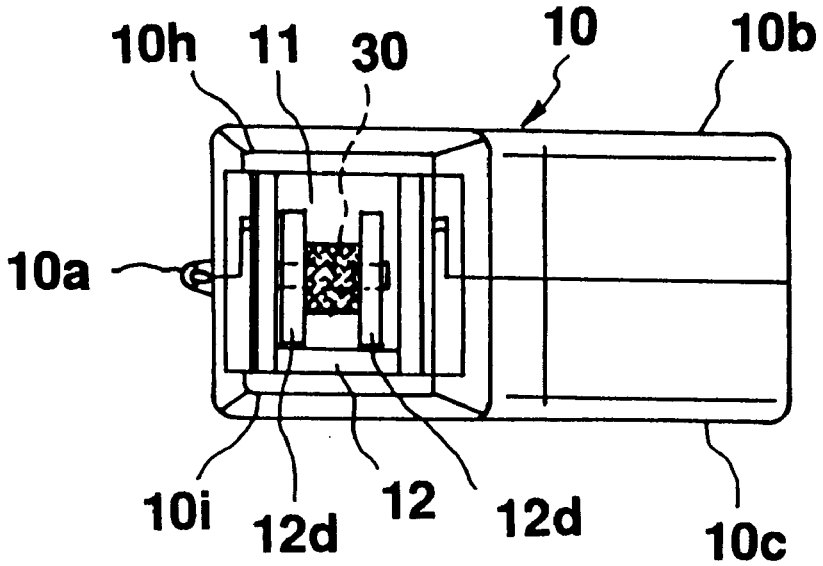
FIG. 3 is a front view of the paint film transfer device shown in FIG. 1.
Figure 4:
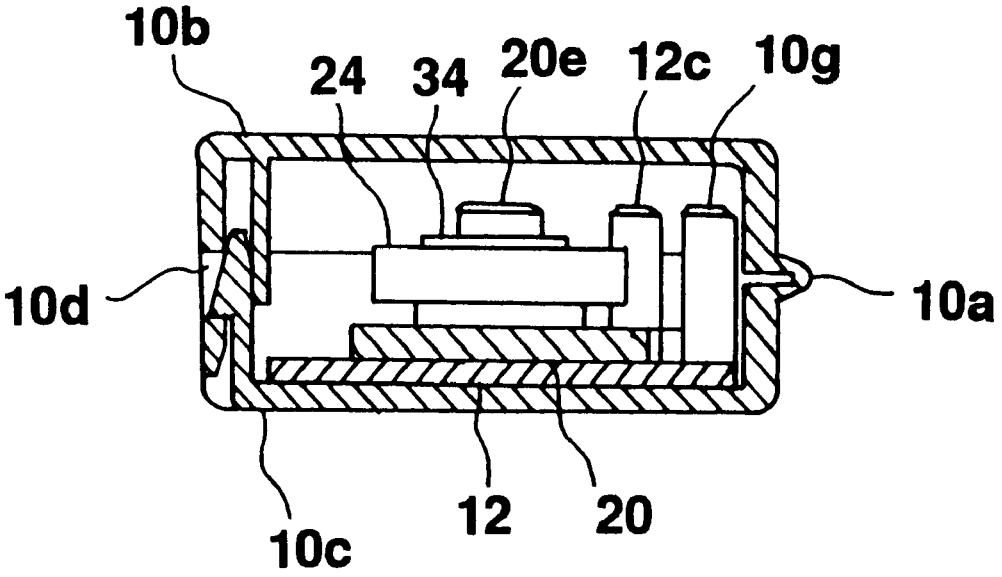
FIG. 4 is a sectional view taken along line 4—4 in FIG. 1.

The paint film transfer tape 16 unwound from the supply reel 18 is guided by a guide pin 10*g* projected from the lower lid 10*c*, twisted by approximately 90 degrees, and fed toward an opening 11 (e.g., as shown in FIG. 3).

A roller 30 is mounted at the opening 11, and is rotatably mounted between vertical walls 12*d* and 12*d* vertically extending from the fixed plate 12 at each side of the opening 11. The roller 30 is desirably engraved with a plurality of irregularities, which facilitate peeling the paint film layer from the paint transfer tape 16. An upper cover 10*h* and a lower cover 10*i* extend from the upper and lower lids 10*b* and 10*c*, above and below the opening 11, respectively, and their front ends are parallel to the roller 30.

The paint film transfer 16 is used while passing around the outer periphery of the roller 30, and becomes the used tape 22. The used tape 22 again proceeds into the case from the opening 11, is again twisted by approximately 90 degrees, and guided by the second projection 12*c* to be wound around the take-up reel 24.

When the paint film transfer device 100 described above is use in an exemplary operation, a user holds the case 10, and rolls the roller 30 while pressing it against a surface, such as a paper surface, onto which the user wants to transfer the paint film. Then, if the user moves the case 10 so that the front end moves parallel with respect to the front ends of the upper and lower covers 10*h* and 10*i*, the roller 30 can be rolled along a substantially straight path. Such rolling of the roller 30 causes the adhesive layer on the paint film transfer tape 16 wound around the roller 30 to adhere to the paper surface, thereby transferring the paint film layer, together with the adhesive layer, to the paper surface or the like.

As the roller 30 rolls, the paint film transfer tape 16 is supplied from the supply reel 18, and the supply reel 18 is rotated. In this case, since the supply reel 18 and the take-up reel 24 affirmatively contact each other with their outermost peripheries (e.g., by virtue of resilient member 20*d*), the take-up reel 24 is rotated together with the supply reel 18 but in an opposite direction thereto, and automatically takes up the used tape 22. For example, the supply reel 18 is rotated in a counterclockwise direction, whereas the take-up reel 24 is rotated in a clockwise direction.

Further, since the supply reel 18 is wound with the paint film transfer tape 16 such that its adhesive layer faces outwardly, a substantial adhesive force is generated between the supply reel 18 and the take-up reel 24, so that the supply reel 18 constantly rotates together with the take-up reel 24 without slippage.

Furthermore, since the supply reel 18 and take-up reel 24 constantly contact each other with their outermost peripheries (e.g., of the supply tape and the used tape on the reels 18, 24, respectively) under a substantially suitable force from the resilient member 20*d*, the supply reel 18 does not slip, and both reels 18 and 24 reliably (e.g., always) rotate together. Thus, the take-up reel 24 takes up the used tape 22 by a length corresponding to the length of the paint film transfer tape 16 supplied from the supply reel 18, and the used tape 22 is completely take-up around the take-up reel 24, so that no slackening occurs on the tape.

Figure 5:
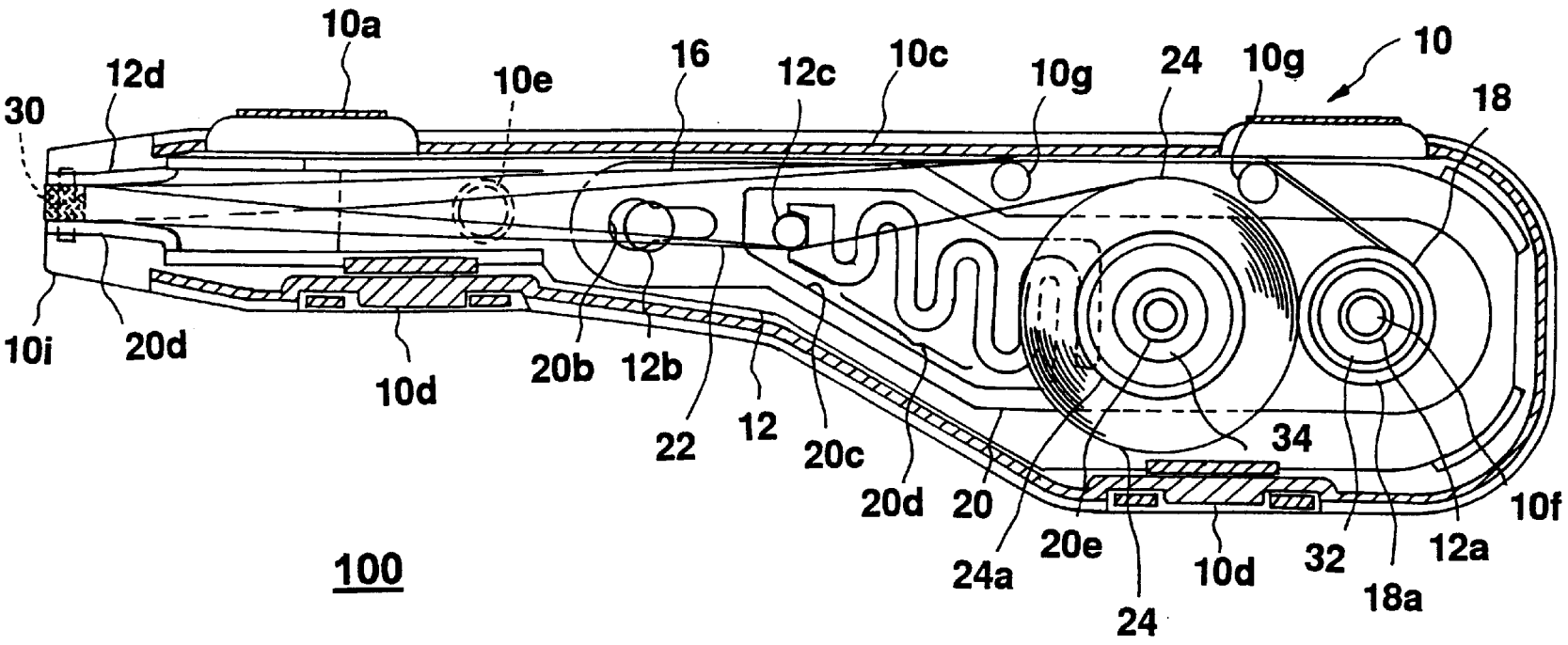
FIG. 5 is similar to FIG. 1, but shows a state where all of a paint film transfer tape for use with the device, is used up.

As the user continues to use the device, the radius of the supply reel 18 (e.g., the radius of the tape wound on the supply wheel) becomes smaller, and that of the take-up reel 24 becomes larger. However, since the paint film transfer tape 16 on the supply reel 18 is thicker than the used tape 22 on the take-up wheel 24, the sum of radii of both reels 18 and 24 (e.g., the tape on both wheels) becomes smaller. According to such a variation of radii, the second support shaft 20*e* is moved toward the first support shaft 12*a* by the resilient member 20*d*, so that the supply reel 18 and the take-up reel 24 always reliably maintain their contacting state. Therefore, even if the supply speed varies as the radius of the tape wound on the supply reel 18 changes, the take-up reel 24 contacting the supply reel 18 with its outermost periphery has the same take-up speed as the supply speed, so that no tape slackening occurs. Then, when all the paint film transfer tape 16 is supplied (e.g, used up), the state becomes as shown in FIG. 5.

After the paint film transfer tape 16 is completely used up, the lock section 10*d* is released to open the upper lid 10*b*. Then, the used tape 22 is removed from the lower lid 10*c* together with the fixed and movable plates 12 and 20 including the roller 30. New paint film transfer tape 16 is loaded by mounting new movable and fixed plates 20 and 12 on which a supply reel 18 wound with the new paint film transfer tape 16 and the hub 24*a* to which the front end of the paint film transfer tape 16 is attached are mounted. In this case, there is no need to route the tape, so that a user can easily replace the tape.

Thus, according to the first embodiment, since supply of the paint film transfer tape 16 can be synchronized with taking-up of the used tape 22 without using gears, complex hardware, or the like, low-cost manufacturing results. Additionally, regardless of changes of radii of the supply and take-up reels 18 and 24 according to usage of the paint film transfer tape 16, synchronization between the tape supply and the tape taking-up is maintained constantly.

Further, since the resilient member 20*d* constantly urges the second support shaft 20*e*, such that the take-up reel 24 is urged toward the supply reel 18, the take-up reel 24 constantly maintains contact with the supply reel 18, and the reels 18 and 24 contact each other under substantial force, whereby slippage is prevented.

Additionally, the number of components can be reduced by integrally forming the resilient member 20*d* and the second support shaft 20*e*, so that low-cost manufacturing results.

Second Embodiment

Figure 6:
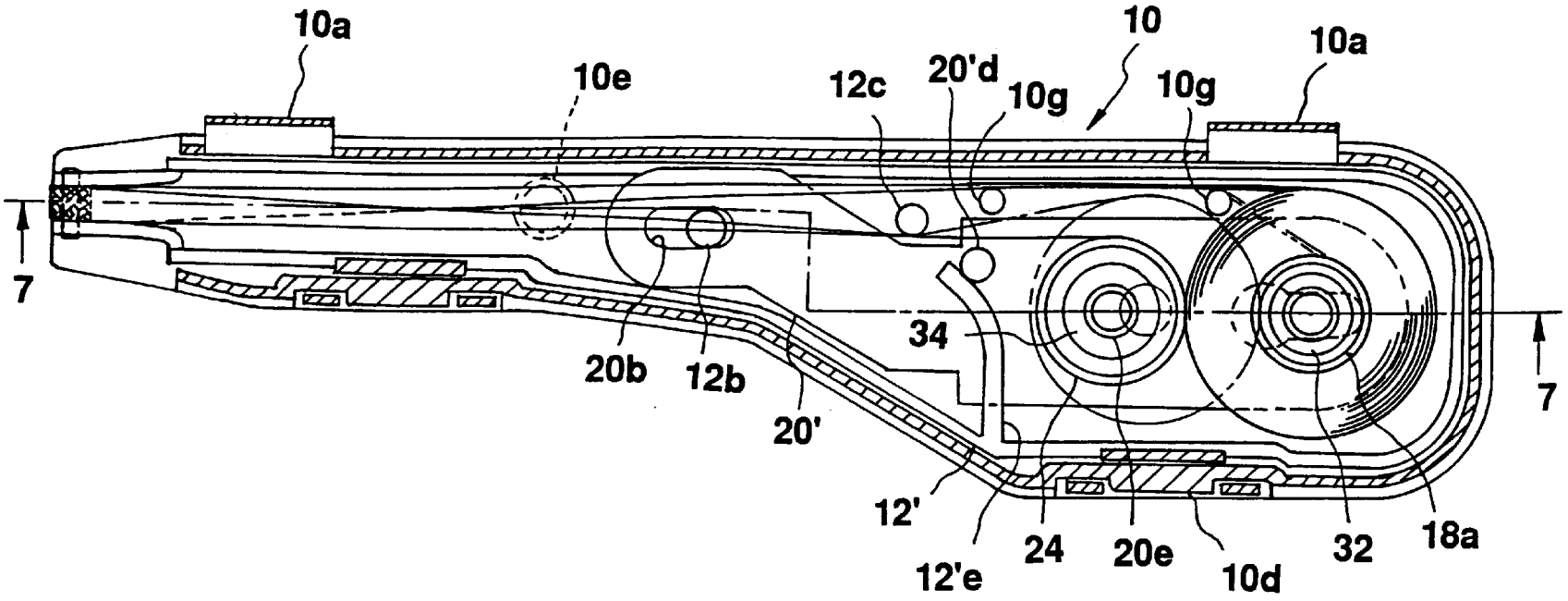
FIG. 6 is similar to FIG. 1, and shows a sectional view of a second embodiment of a paint film transfer device according to the present invention.
Figure 7:
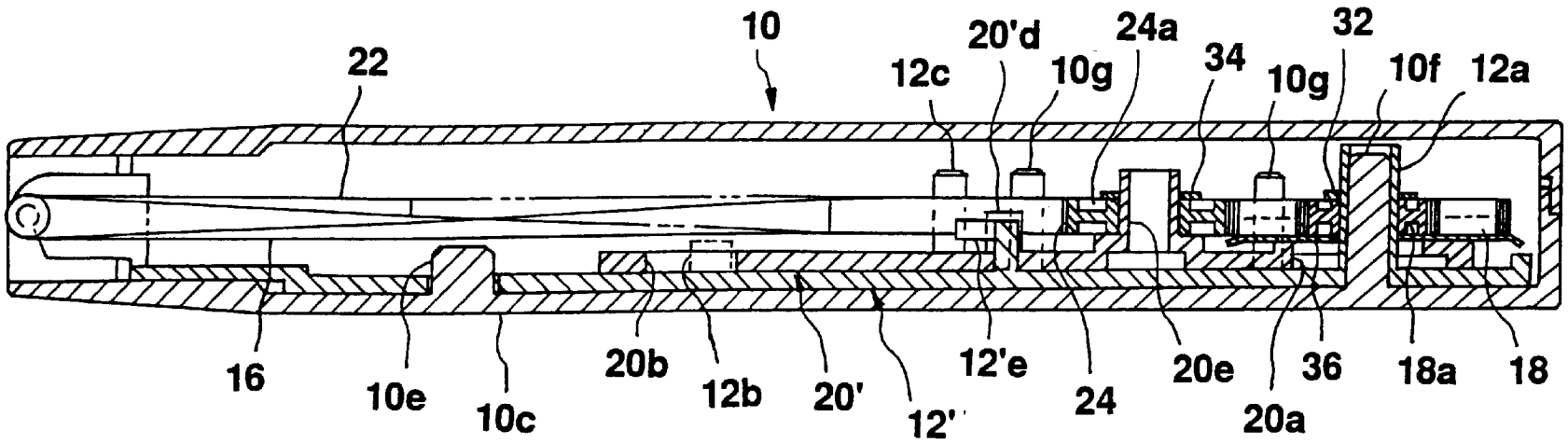
FIG. 7 is similar to FIG. 2, and shows a sectional view of the paint film transfer device shown in FIG. 6.

FIGS. 6–7 illustrates a second embodiment according to the present invention. FIG. 6 is similar to FIG. 1, but shows a sectional view of the second embodiment of a paint film transfer device according to the present invention, whereas FIG. 7 is a sectional view taken along line 7–7 in FIG. 6. Similar components to the first embodiment are denoted with the same reference numerals, and, for brevity, a description of the similar components is omitted herein.

The second embodiment forms a resilient member integrally with a fixed plate on which a first support shaft is formed, instead of forming the resilient member integrally with the movable plate formed with a second support shaft, as in the first embodiment.

That is, the fixed plate 12' is formed with an arm 12'*e* extending over the movable plate 20' in an inverted L-shape. The arm 12'*e* engages a projection 20'*d* projecting from the movable plate 20', and urges the movable plate 20' rightwardly (e.g., as shown in FIG. 6), or urges the second support shaft 20*e* supporting the take-up reel 24 toward the supply reel 18.

Such an arrangement is operated similarly to the first embodiment (e.g., a phantom line shown in FIG. 6 illustrates a state where the paint film transfer tape 16 is completely used up), and the number of components is the same as in the first embodiment.

While, in the above embodiments, the second support shaft 20*e* supporting the take-up reel 24 is arranged to be movable, and urged in a direction approaching the supply reel 18, the present invention is not limited to such arrangement. Thus, the first support shaft 12*a* supporting the supply reel 18 may be made movable, thereby to urge the supply reel 18 toward the take-up reel 24.

Additionally, while the urging mechanism (e.g., including the resilient member 20*d*) is described as preferably being formed integrally with either the movable plate or the fixed plate, a separate urging mechanism, such as a coil or leaf spring, could be provided as would be known by one of ordinary skill in the art taking the present application as a whole.

Further, while the above-described embodiments have been optimized for use with a paint film transfer tape, other types of films, tapes, media, and substances, would find great benefit in the present invention.

Hence, while the principles of the invention have been described above in connection with specific embodiments, and particular modifications thereof, it is to be clearly understood that this description is made only by way of example and not as a limitation on the scope of invention. Thus, while the invention has been described in terms of several preferred embodiments, those skilled in the art will recognize that the invention can be practiced with modification within the spirit and scope of the appended claims.

What is claimed is:

1. A film transfer device, comprising:

a case;

a supply reel around which a film transfer tape is wound;

a take-up reel for taking-up used film transfer tape which is supplied from said supply reel and used, said supply reel and said take-up reel being rotatably mounted in said case; and an urging mechanism for constantly urging at least one of said supply reel and said take-up reel in a direction such that said supply reel and said take-up reel approach each other, wherein an outermost periphery of the film transfer tape wound on said supply reel and an outermost periphery of the used film transfer tape taken-up on said take-up reel constantly contact each other, such that said take-up reel rotates as said supply reel rotates by frictionally contacting the outermost periphery of the film transfer tape with the outermost periphery of the used film transfer tape.

2. The film transfer device according to claim 1, further comprising a support shaft for rotatably supporting said at least on of said supply reel and said take-up reel, wherein said urging mechanism is formed integrally with said support shaft.

3. The film transfer device according to claim 1, wherein said case includes:

a fixed plate attached thereto including a first support shaft; and a movable plate positioned on the fixed plate, said movable plate including first and second elongated holes for slidable receiving, respectively, the first support shaft of the fixed plate and a projection projecting from the fixed plate, such that said movable plate is slidable in a longitudinal direction of the case with respect to the fixed plate.

4. The film transfer device according to claim 3, wherein said movable plate includes an opening, and said urging mechanism includes a resilient member extending in the opening in a zigzag shape, said resilient member being formed integrally with the movable plate.

5. The film transfer device according to claim 4, said resilient member being expandable and retractable as its zigzag shape is deformed, and generating a resilient urging force, said fixed plate having a second projection, a first end of said resilient member engaging said second projection and said movable plate having a second support shaft formed between the opening and the second elongated hole.

6. The film transfer device according to claim 5, wherein said supply reel is rotatably fitted on the first support shaft of the fixed plate, and said take-up reel is rotatably fitted on the second support shaft of the movable plate, the resilient member urging said second support shaft supporting the take-up reel toward the first support shaft.

7. The film transfer device according to claim 6, wherein said tape includes a paint film transfer tape including a plastic-based film on which laminated a peeling layer and a paint film layer, on which an adhesive layer is laminated, said supply reel including a hub around which said paint film transfer tape is wound such that the adhesive layer faces outwardly, a used tape on said take-up reel being the paint film transfer tape having had the paint film layer and the adhesive layer removed, said used tape being wound on said take-up reel such that the peeling layer faces outwardly.

8. The film transfer device according to claim 7, wherein said case further comprises a guide pin projecting from said case such that said transfer tape unwound from said supply reel is guided by said guide pin, twisted by approximately 90 degrees, and fed toward said opening in said case, further comprising a roller rotatably mounted at the opening, between walls of said fixed plate at each side of the opening, said roller having a plurality of irregularities, wherein the paint film transfer tape is used while passing around an outer periphery of the roller, and becomes the used tape, the used tape proceeding into the case from the opening, and being retwisted by approximately 90 degrees, and guided by said second projection of said fixed plate to be wound around said take-up reel, wherein, as the roller rolls, the paint film transfer tape is supplied from said supply reel, and said supply reel is rotated to cause said take-up reel to rotate correspondingly and in an opposite direction thereto to take-up automatically the used tape, wherein the supply reel includes the paint film transfer tape wound such that said adhesive layer faces outwardly, and an adhesive force is generated between said supply reel and said take-up reel, so that said supply reel constantly rotates together with said take-up reel.

9. The film transfer device according to claim 1, wherein said take-up reel takes up used tape by a length corresponding to a length of the film transfer tape supplied from said supply reel, and the used tape is taken-up around said take-up reel, such that substantially no slackening occurs on the film transfer tape.

10. The film transfer device according to claim 5, wherein, during use of said device, a sum of radii of tape on said supply reel and said take-up reel becomes smaller and said resilient member urges said second support shaft toward said first support shaft, such that said supply reel and said take-up reel maintain their contacting state and said take-up reel contacting said supply reel with its outermost periphery has a same take-up speed as a supply speed of said supply reel.

11. The film transfer device according to claim 1, wherein supply of the film transfer tape is synchronized with taking-up of the used tape, wherein regardless of changes of radii of the tape wound on said supply reel and said take-up reel according to usage of the film transfer tape, synchronized between tape supply and tape taking-up is maintained constantly.

12. The film transfer device according to claim 5, wherein said resilient member constantly urges said second support shaft, such that said take-up reel is urged toward said supply reel, and said take-up reel constantly maintains contact with said supply reel, and wherein the resilient member is integrally formed with said second support shaft.

13. The film transfer device according to claim 1, further comprising:

a fixed plate including a first support shaft for supporting said at least one of said supply reel and said take-up reel; and a movable plate for supporting the other of said supply reel and said take-up reel, wherein said urging mechanism is integrally formed with said fixed plate on which said first support shaft is formed, said fixed plate including an arm extending over the movable plate, and said movable plate including a projection projecting therefrom.

14. The film transfer device according to claim 13, further comprising a second support shaft for rotatably supporting the other of said supply reel and said take-up reel, wherein said arm engages said projection projecting from the movable plate, and urges the movable plate to urge said second support shaft toward said first support shaft.

15. A paint film transfer device, comprising:

a supply reel around which a paint film transfer tape is wound;

a take-up reel for taking-up used film transfer tape which is supplied from said supply reel and used, said supply reel and said take-up reel being rotatably mounted;

a case, the supply and take-up reels being rotatably mounted in the case; and urging means for constantly urging at least one of said supply reel and said take-up reel in a direction such that said supply reel and said take-up reel approach each other, wherein an outermost periphery of the film transfer tape wound on said supply reel and an outermost periphery of the used film transfer tape taken up on said take-up reel constantly contact each other, such that said take-up reel rotates as said supply reel rotates by frictionally contacting the outermost periphery of the film transfer tape with the outermost periphery of the used film transfer tape.

16. The paint film transfer device as set forth in claim 15, further comprising a support shaft for rotatably supporting said at least one of said supply reel and said take-up reel, wherein said urging means is formed integrally with said support shaft.

17. The paint film transfer device as set forth in claim 15, further comprising:

a fixed plate including a first support shaft for supporting said at least one of said supply reel and said take-up reel; and a movable plate for supporting the other of said supply reel and said take-up reel, wherein said urging means is integrally formed with said fixed plate on which said first support shaft is formed, said fixed plate including an arm extending over the movable plate, and said movable plate including a projection projecting therefrom.

18. The paint film transfer device according to claim 17, further comprising a second support shaft for rotatably supporting the other of said supply reel and said take-up reel and said take-up reel, wherein said arm engages said projection projecting from the movable plate, and urges the movable plate to urge said second support shaft toward said first support shaft.

* * * * *